United States Patent [19]

Morris

[11] 4,236,867

[45] Dec. 2, 1980

[54] FRICTION REDUCING ARRANGEMENT FOR HYDRAULIC MACHINES

[75] Inventor: Joseph H. Morris, Queenstown, Md.

[73] Assignee: The United States of America as represented by the Secretary of the Navy, Washington, D.C.

[21] Appl. No.: 61,777

[22] Filed: Jul. 27, 1979

[51] Int. Cl.[3] ..... F01D 11/00

[52] U.S. Cl. ..... 415/26; 415/110; 415/112

[58] Field of Search ..... 415/26, 47, 49, 110, 415/111, 112, 116, 117, 170 R, 170 A, 170 B, 175

[56] References Cited

U.S. PATENT DOCUMENTS

| | | | |
|---|---|---|---|
| 3,044,744 | 7/1962 | Berlyn | 415/117 X |
| 3,172,640 | 3/1965 | Sproule | 415/117 |
| 3,174,719 | 3/1965 | Sproule et al. | 415/110 |
| 3,188,050 | 6/1965 | Koeller | 415/117 |
| 3,236,499 | 2/1966 | Chatfield et al. | 415/111 X |
| 3,239,193 | 3/1966 | Kerensky | 415/110 |
| 3,245,656 | 4/1966 | Desbaillets et al. | 415/112 |
| 3,405,913 | 10/1968 | Chatfield et al. | 415/112 X |
| 3,635,582 | 1/1972 | Sproule | 415/110 X |
| 3,724,966 | 4/1973 | Sproule | 415/110 X |
| 3,966,351 | 6/1976 | Sproule | 415/110 |

*Primary Examiner*—Stanley N. Gilreath

*Attorney, Agent, or Firm*—R. S. Sciascia; L. A. Marsh

[57] ABSTRACT

A hydraulic machine comprising a rotor concentrically supported in a fluid chamber of the housing wherein upper and lower annular fluid spaces defined between the rotor and housing include upper cavity regions formed radially adjacent the rotor axis and lower cavity regions declined radially therefrom. Fluid supply ports in the upper cavity regions of the annular spaces permit flow of a relatively low density pressurized fluid into the annular spaces to control the level of pumped fluid therein and seal elements span the upper regions of the annular spaces for maintaining pressure differentials between the annular spaces and fluid passages of the housing. Clearance gaps, defined by circumferential edges of the rotor and adjacent surfaces of the fluid chamber, radially bound the lower cavity regions of the annular spaces for limiting the flow of pumped fluid into and out of the annular spaces.

11 Claims, 1 Drawing Figure

FRICTION REDUCING ARRANGEMENT FOR HYDRAULIC MACHINES

The invention described herein may be manufactured and used by or for the Government of the United States of America for governmental purposes without the payment of any royalties thereon or therefor.

BACKGROUND OF THE INVENTION

This invention is directed to an improved rotary hydraulic machine and more particularly relates to a rotary pump/turbine, hereinafter referred to as a pump, wherein energy losses due to fluid friction are reduced by introducing into spaces defined between the rotor and the housing a fluid of less density and viscosity than the working or pumped fluid.

In conventional rotary or centrifugal pumps, a rotating rotor or impeller within a stationary housing is used to impart energy to the pumped fluid wherein a relatively small space defined between the rotating element and the housing often becomes filled with the pumped fluid. Energy losses dissipated through shearing of the pumped fluid in such spaces can amount to as much as twelve percent or more of the total power input, depending upon the type and design of the pump. Such frictional power loss caused by shearing of the fluid is generally set forth by the relationship, power loss$=KD^2du^3$ wherein K is a numerical coefficient dependent upon the Reynolds number, rotor surface finish, and rotor to housing clearance; D is the rotor diameter; d is the fluid density; and u is the peripheral velocity of the rotor. Attempts made to minimize such power losses include optimizing the clearance between the rotor and the housing as well as polishing or coating adjacent portions of the rotor and housing to obtain surfaces having a lower effective friction coefficient. Another proposal involves the installation of one or more free-rotating disks between the rotor and casing wherein such rotating disks reduce the relative velocity differential between the rotating and stationary boundaries, thus reducing friction losses therebetween.

Further attempts to reduce fluid friction have involved the substitution of a fluid of less density and lower viscosity than the pumped fluid in the spaces between the rotor and the housing. As exemplified by U.S. Pat. Nos. 3,044,744 and 3,172,640, for example, air is introduced into spaces between the rotor and housing surfaces. Additionally, U.S. Pat. Nos. 3,174,719; 3,188,050; 3,236,499; 3,405,913; 3,635,582; and 3,724,966 effect sealing of the aerated spaces by establishing and maintaining water and/or labyrinth seals to prevent excessive losses of the air or gas used in such spaces. Recognizing that reasonable prevention of gas or air loss in the aerated spaces requires seals of substantial effective width and that fluid friction losses at a runner seal vary as the 4th power of the diameter, the width and clearance tolerances as well as the relative position of such seals in the pump structures of the type in the aforementioned patents has been the subject of much investigation. However, the need for continuous supervision of the supply of sealing fluid to the seal structures and the close operating tolerances of the labyrinth seals, for example, provides many inherent disadvantages and limitations on the use of such seal structures. Additionally, the seal structures of the prior art are generally not readily adaptable to either the condition wherein a gas of varying temperature and pressure is used or wherein sizeable pressure differentials exist between the pumped fluid and the annular spaces between the rotor and the housing. Accordingly, the structure of the present invention is designed to overcome disadvantages of the prior art, such as varying pressure differentials between the pumped fluid and the aerated spaces which results in intermittent seal loss.

SUMMARY OF THE INVENTION

The pump structure of the present invention generally comprises a housing having a central inlet passage, an outlet passage radially disposed therefrom, a fluid chamber formed therebetween and a rotor concentrically supported in the fluid chamber. Upper and lower annular spaces are defined between the upper and lower surfaces of the rotor and respective adjacent surfaces of the fluid chamber wherein upper cavity regions of the annular spaces are located adjacent the rotor axis and lower cavity regions of the annular spaces are radially declined from the upper cavity regions of the annular spaces and the rotor axis. The lower cavity regions of the annular spaces are peripherally bounded by clearance gaps defined by the circumferential edges of the rotor and adjacent upper and lower surfaces of the fluid or pump chamber. Further, seal elements positioned in upper cavity regions of the annular spaces maintain a fluid seal between the rotor and the housing for preventing fluid from escaping therefrom. Thus, such annular spaces form bubble chambers wherein low density fluid or gas introduced therein becomes trapped and resulting pressure increases of the low density fluid or gas relative to the pressure of the pumped fluid generally decreases the level of pumped fluid in the annular spaces and forces the pumped fluid through the clearance gaps.

Sensing and supply means are provided for automatically introducing and controlling the supply of gas or fluid in the annular spaces to maintain a predetermined pressure and temperature therein. Such sensing and supply means also automatically functions in response to variations in pressure differential between the pressurized fluid in the annular spaces and the pumped fluid to maintain the pressure of fluid in the annular spaces between predetermined values.

Accordingly, it is therefore an object of the present invention to provide a pump structure wherein fluid friction is reduced by maintaining a fluid or less density and viscosity than the pumped fluid in the spaces defined between the rotor and the adjacent housing structure.

A further object of this invention is the provision of a novel and improved pump assembly which can be inexpensively manufactured and serviced, has a long useful life and is relatively efficient.

Another object of this invention is to provide a new and improved sealing means which permits flow of pumped liquid into and out of the spaces between the rotor and housing while impeding the escape of gaseous and less dense fluids therefrom.

Yet another object of the present invention is the provision of means supplying pressurized fluid to the annular cavities to maintain a predetermined pressure and temperature of such fluid in the annular cavities and to control the level of pumped fluid therein.

BRIEF DESCRIPTION OF THE DRAWING

The novel features which are believed to be characteristic of this invention are set forth with particularly in the appended claims. The invention itself, however, both as to its organization and method of operation, together with further objects and advantages thereof, may be best understood by reference to the following description taken in connection with the accompanying drawing, in which:

DETAILED DESCRIPTION OF THE DRAWING

Figure 1:
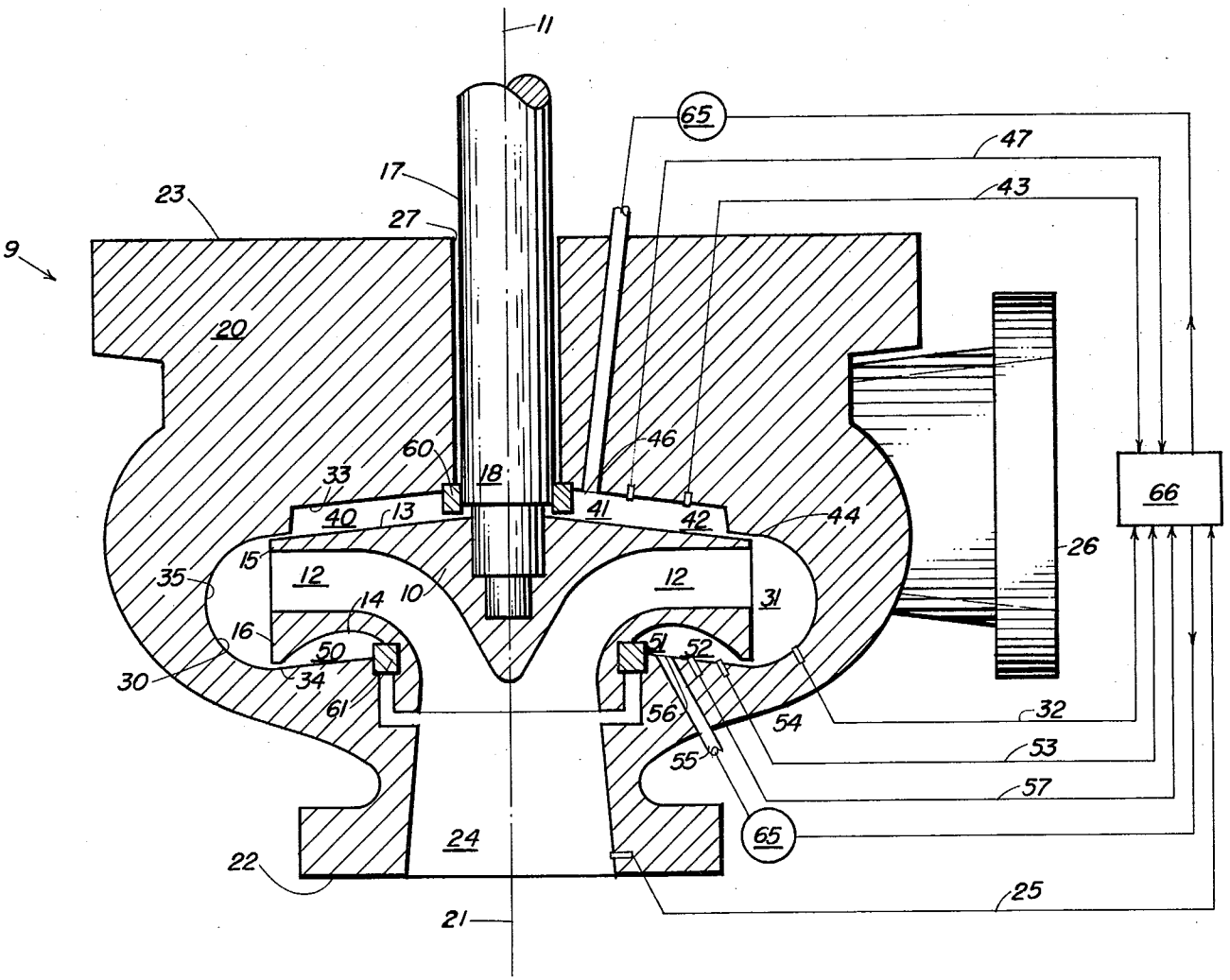
FIG. 1 is a sectional view of the pump assembly.

Referring to the drawing wherein the hydraulic machine of the present invention is capable of use either as a vertically mounted pump or a turbine and hereinafter described in reference to a pump, the pump assembly 9 generally comprises a rotor 10 rotatably mounted in a stationary pump housing 20. The housing 20, which has a vertical axis 21 shown in FIG. 1, includes an inlet passage 24 centrally formed in the lower portion 22 of the housing 20, an outlet passage 26 radially spaced therefrom, and a fluid chamber 30 concentrically formed in the housing 20 and communicating with the inlet 24 and outlet 26 passages. Concentrically formed in an upper portion 23 of the housing 20 is a shaft conduit 27 communicating with the fluid chamber 30 for receiving a rotor shaft 17 such that a shaft end portion 18 is positioned in the fluid chamber 30. The shaft end portion 18 rotationally supports a rotor 10 which is concentrically mounted in the fluid chamber 30. The rotor 10 includes a rotational axis 11 substantially coincident with housing axis 21 and a plurality of radially extending fluid passageways 12 extending therethrough for forming fluid flow paths between the inlet 24 and outlet 26 passages. Thus, in operation of the pump assembly 9, liquid enters the pump from the inlet passage 24, passes through the fluid passageways 12 in the rotor 10 and is discharged from the peripheral region 31 of the fluid or pump chamber 30 through the outlet passage 26.

Fluid chamber 30 of the housing 20 is defined by upper 33 and lower 34 chamber surfaces radially extending from the housing axis 21 and an axial peripheral surface portion 35 extending therebetween, wherein such surfaces can be polished or coated with various materials to reduce fluid friction. Similarly, the rotor 10 includes upper 13 and lower 14 surfaces as well as a circumferential surface portion 15 extending substantially concentric with the housing axis 21. Hence, as shown in FIG. 1, the respective upper 33 and lower 34 surfaces of the fluid chamber 30 and the upper 13 and lower 14 surfaces of the rotor 10 are cooperatively contoured to define upper 40 and lower 50 annular spaces therebetween. The upper annular space 40 slopes downwardly or declines from the rotor axis 11 such that an upper cavity region 41 is formed radially adjacent the housing axis 11 and a lower cavity region 42 is radially spaced therefrom. Although of somewhat different configuration than the upper annular space 40, the lower annular space 50 likewise declines from axis 11 and include an upper cavity region 51 and a lower cavity region 52 formed radially outwardly therefrom, generally adjacent a circumferential rib 16 depending from the lower surface 14 of the rotor 10. Thus, both annular spaces 40, 50 function as bubble chambers wherein fluids having less density and a lower viscosity than the working or pumped fluid can be introduced and trapped in the upper cavity regions 41, 51 of such spaces.

Seal means in the form of a shaft seal element 60 and a suction seal element 61 are respectively interposed between the rotor 10 and the housing 20 in the upper cavity regions 41, 51 of the annular spaces 40, 50 for preventing fluids from escaping therefrom. Accordingly, the pump structure of the present invention is particularly well suited for operating conditions where potentially large or varying pressure differentials exist between the annular spaces 40, 50 and the shaft conduit 27 and/or the inlet passage 24. Peripheral sealing means, in the form of an upper clearance gap 44 defined between the outer circumferential edge of the upper rotor surface 13 and the chamber upper surface 33 and a lower clearance gap 54 defined between the rotor rib 16 and the chamber lower surface 34, limits the flow rate of pumped fluid into and out of the annular spaces while fluids of lower density are effectively maintained therein by the residual pumped fluid. Since the inclined configuration of the annular spaces 40, 50 comprise a primary means for maintaining the pressurized fluid in the annular spaces 40, 50, the radial width of the clearance gaps 44, 54 can be accordingly reduced and the spacing increased, resulting in corresponding decreased in the fluid friction losses thereabout.

Means for supplying and regulating the amount and pressure of relatively low density fluid introduced into the annular spaces 40, 50 generally includes various fluid supply lines and pressure sensing means. Fluid supply conduits 45, 55 and ports 46, 56, extending from a suitable source 65 of pressurized fluid, are respectively connected to the upper cavity regions 41, 51 of the annular spaces 40, 50 for introducing such pressurized fluid therein. Further, pressure sensing means 25, 32, 43 and 53 are respectively connected to the inlet passage 24, to the peripheral region 31 of the fluid chamber 30 and to the annular spaces 40, 50. The abovementioned pressure sensing means are connected to pressure control means 66 which controls the supply of relatively low density pressurized fluid to the annular spaces through suitable conduits and ports while maintaining a desired level of the pumped fluid in the annular spaces in response to pressure changes.

Temperature sensing means in the form of sensing elements 47, 57 respectively located in the upper 40 and lower 50 annular spaces, as shown in FIG. 1, are connected to the pressure control means 66 to provide a mechanism for introducing fluid of predetermined temperature and pressure into the annular spaces and for withdrawing such fluid out of the annular spaces 40, 50 through conduit means such as conduits 45, 55 to maintain a predetermined temperature and pressure therein. Thus, the pump structure of the present invention is particularly adaptable for pumping fluids of varying temperatures and pressures. For example, when employed as a feedwater pump for various boiler apparatus, exhaust steam can be recirculated to the pump and introduced into the annular spaces 40, 50 as pressurized fluid of a predetermined temperature, pressure and density. Accordingly, as the steam heats the adjacent pump structure and the feedwater, it condenses to a fluid state whereupon it tends to flow radially outwardly toward the clearance gaps 44, 54 and eventually mixes with the pumped feedwater. By maintaining the mass flow rate of steam into the annular spaces 40, 50 within predetermined values relative to other operational parameters, such as feedwater pressure, substantially all of the recirculated steam can be condensed to a liquid state, thereby eliminating potential operational problems, such as cavitation, associated with gaseous or vaporous fluids being introduced into the feedwater.

In operation, the annular spaces 40, 50 are normally filled with working fluid as the pump 9 is started. As the rotor 10 commences to rotate, it imparts a rotary motion to the working or pumped fluid wherein centrifugal force tends to cause the working fluid in the spaces to be displaced radially outwardly while the fluid or gas of less density migrates toward the low velocity, low pressure zone in upper cavity regions of the spaces. This is sometimes referred to as the buoyancy effect. Introduction of pressurized fluid of lower density and less viscosity than the working fluid into the annular spaces 40, 50 tends to cause further radial displacement of the working fluid and hence, the level of working fluid in the annular spaces can be controlled by suitably controlling the pressure and temperature of the pressurized fluid therein. However, if the introduction of pressurized fluid into the annular spaces 40, 50 is delayed until the rotor 10 has reached a relatively high rotational speed, it may be necessary to purge the annular spaces 40, 50 with a relatively high initial flow of pressurized fluid for a short period of time inasmuch as the toroidal circulation of the working fluid between the clearance gaps 44, 54 may tend to form a stable interface between fluid in the pump chamber and the annular spaces which may reduce mixing of the fluids.

Obviously many modifications and variations of the present invention are possible in the light of the above teachings. For example, the structure of the present invention is particularly applicable to multistage pumps wherein cessation of pumping activity would not result in adverse loss of the relatively low density fluid, such as would occur with prior art structures, and wherein such low density fluid remains trapped in the upper cavity regions of the annular spaces, subject to removal through fluid pipes such as fluid conduits 45, 55. It is therefore to be understood that within the scope of the appended claims, the invention may be practiced otherwise than as specifically described.

What is claimed is:

1. A pump assembly comprising:

a housing having a vertical axis and including a central inlet passage generally concentric with said axis, an outlet passage radially disposed with respect to said housing axis, and a fluid chamber formed therebetween, said chamber having spaced upper and lower radially extending surfaces;

a conduit extending through an upper portion of said housing and communicating with said fluid chamber;

a shaft positioned within said conduit and being generally concentric with said housing axis, an end portion of said shaft being positioned within said fluid chamber;

a rotor rotationally supported by said end portion of said shaft and concentrically mounted in said fluid chamber, said rotor having a rotational axis substantially coincident with said housing axis and at least one fluid passageway extending through said rotor for forming a fluid flow path between said inlet and outlet passages, said rotor further having upper and lower surfaces;

upper and lower annular spaces respectively defined between said upper and lower surfaces of said rotor and said upper and lower surfaces of said chamber, said upper and lower annular spaces include upper cavity regions radially adjacent said housing axis and lower cavity regions extending radially therefrom, said lower cavity regions of said annular spaces being bounded by clearance gaps defined by circumferential edges of said rotor and respective portions of said upper and lower surfaces of said housing, and said upper and lower annular spaces being declined radially from said housing axis;

seal means interposed between said rotor and said housing in said upper cavity region of said upper and lower annular spaces, said seal means in said lower annular space being adapted to maintain a pressure differential between said inlet passage and said lower annular space;

peripheral sealing means formed at said clearance gaps for limiting the flow of pumped fluid into and out of said upper and lower annular spaces through said clearance gaps;

a fluid supply port in each said upper cavity region of said upper and lower annular spaces; and means supplying pressurized fluid through said supply ports to said annular spaces for decreasing the level of pumped fluid in said annular spaces as the pressure of the pressurized fluid is increased relative to the pressure of the pumped fluid and for increasing the level of pumped fluid in said annular spaces as the pressure of the pressurized fluid is decreased relative to the pressure of the pumped fluid, said annular cavities forming bubble chambers entrapping the pressurized fluid therein with the sole means for escape of pressurized fluid and pumped fluid being through said clearance gaps in said lower cavity regions of said upper and lower annular spaces.

2. The assembly of claim 1, further comprising automatic means functioning in response to variations in pressure differential between the pressurized fluid in said annular spaces and the pumped fluid to vary the pressure of pressurized fluid in said annular spaces to maintain said pressure differential between predetermined values.

3. The assembly of claim 1, wherein said pressurized fluid is less dense than said pumped fluid.

4. The assembly of claim 1, wherein said sealing means is composed of an elastomeric material.

5. A rotary hydraulic machine comprising:

a housing having a vertical axis and passage means for movement of pumped fluid therethrough;

a rotor rotationally mounted in said housing about said vertical axis, said rotor having axially spaced upper and lower rotor surfaces with means defining fluid flow channels extending therebetween;

upper and lower annular spaces respectively defined between said upper rotor surface and said housing and between said lower rotor surface and said housing, said upper and lower annular spaces being declined radially from said housing axis;

upper and lower annular clearance gaps defined between the peripheral edge portions of said upper and lower rotor surfaces and said housing;

means supplying pressurized fluid to said annular spaces for decreasing the level of pumped fluid in said annular spaces as the pressure of pressurized fluid is increased relative to the pressure of the pumped fluid and for increasing the level of pumped fluid in said annular spaces as the pressure of the pressurized fluid is decreased relative to the pressure of the pumped fluid.

6. The assembly of claim 5 wherein said upper annular space includes a lower cavity portion adjacent said upper clearance gap and an upper cavity portion extending radially between said lower cavity portion and the rotor axis.

7. The assembly of claim 6, further comprising automatic means functioning in response to variations in pressure differential between the pressurized fluid in said annular spaces and the pumped fluid to vary the pressure of pressurized fluid in said annular spaces to maintain said pressure differential between predetermined values and said clearance gaps in said upper and lower annular spaces forming flow restrictions for impeding flow of pressurized fluid out of said annular spaces through said clearance gaps and permitting flow of pumped fluid into and out of said annular spaces through said clearance gaps.

8. The assembly of claim 7, further comprising fluid ports in said upper and lower annular spaces and means for introducing fluid of predetermined temperature and pressure into said annular spaces and for withdrawing such fluid out of said ports to maintain a predetermined temperature and pressure in said annular spaces.

9. The assembly of claim 5, wherein said annular spaces are inclined to and extend from adjacent the rotational axis of said rotor toward the periphery of said rotor at a lower level such that said lower annular space includes a lower cavity portion adjacent said lower clearance gap and an upper cavity portion radially extending between said lower cavity portion and the rotor axis.

10. A rotary hydraulic machine comprising:

a housing having a vertical axis and passage means for movement of pumped fluid therethrough;

a rotor rotationally mounted in said housing about said vertical axis, said rotor having axially spaced upper and lower rotor surfaces with means defining fluid flow channels extending therebetween;

an upper annular space defined between said upper rotor surface and said housing and a lower annular space defined between said lower rotor surface and said housing, said upper and lower annular spaces being declined radially from said housing axis, whereby said upper and lower annular spaces each include a lower cavity portion and an upper cavity portion said upper cavity portion extending between said lower cavity portion and said housing axis; and means supplying pressurized fluid to said annular spaces for controlling the level of pumped fluid in said annular spaces.

11. The rotary hydraulic machine according to claim 10, further comprising upper and lower clearance gaps defined between the peripheral edge portions of said upper and lower rotor surfaces and said housing, wherein the sole means for escape of pressurized fluid and pumped fluid being through said clearance gaps in said lower cavity regions of said upper and lower annular spaces.

* * * * *